US009595189B2

(12) United States Patent
Takao et al.

(10) Patent No.: US 9,595,189 B2
(45) Date of Patent: Mar. 14, 2017

(54) TRAFFIC CONTROL DEVICE, TRAFFIC CONTROL METHOD, AND PROGRAM

(71) Applicant: MITSUBISHI HEAVY INDUSTRIES, LTD., Tokyo (JP)

(72) Inventors: Kenji Takao, Tokyo (JP); Toshihiko Niinomi, Tokyo (JP); Takayuki Kono, Tokyo (JP)

(73) Assignee: MITSUBISHI HEAVY INDUSTRIES LTD., Tokyo (JP)

( * ) Notice: Subject to any disclaimer, the term of this patent is extended or adjusted under 35 U.S.C. 154(b) by 0 days.

(21) Appl. No.: 14/767,199

(22) PCT Filed: Sep. 26, 2013

(86) PCT No.: PCT/JP2013/076153
§ 371 (c)(1),
(2) Date: Aug. 11, 2015

(87) PCT Pub. No.: WO2014/125671
PCT Pub. Date: Aug. 21, 2014

(65) Prior Publication Data

US 2016/0005310 A1 Jan. 7, 2016

(30) Foreign Application Priority Data

Feb. 18, 2013 (JP) ..... 2013-029305

(51) Int. Cl.
*G08G 1/00* (2006.01)
*B61L 27/00* (2006.01)

(52) U.S. Cl.
CPC ..... *G08G 1/00* (2013.01); *B61L 27/0011* (2013.01); *B61L 27/0027* (2013.01)

(58) Field of Classification Search
CPC ..... G08G 1/00; G08G 1/0962; G08G 1/09; B61L 27/0011; B61L 27/0027; B60L 15/2045
See application file for complete search history.

(56) References Cited

U.S. PATENT DOCUMENTS

2014/0012454 A1* 1/2014 Fournier ..... G06Q 10/04 701/23

FOREIGN PATENT DOCUMENTS

JP S61-37149 B2 8/1986
JP 2000-198444 A 7/2000
(Continued)

OTHER PUBLICATIONS

PCT/ISA/210, "International Search Report for International Application No. PCT/JP2013/076153," Oct. 22, 2013.
(Continued)

*Primary Examiner* — Michael D Lang
(74) *Attorney, Agent, or Firm* — Manabu Kanesaka; Benjamin Hauptman; Kenneth Berner

(57) ABSTRACT

Adjustment values, including a station stop time or a departure interval, are set for each vehicle. Next, the set adjustment values and a traveling pattern are used to calculate the power consumption by and regenerative power from each vehicle when in operation for each time point. Next, the total vehicle power at each time point is calculated by subtracting the total regenerative power from braking vehicles from the total power consumption by powering vehicles one a per time point basis. Next, a positive value or a negative value is extracted from the total vehicle power at each time point. Next, an evaluation value is calculated using the absolute value of the total of the extracted values. Next, adjustment values that produce the smaller evaluation value are identified.

10 Claims, 5 Drawing Sheets

(56) References Cited

FOREIGN PATENT DOCUMENTS

| | | | |
|---|---|---|---|
| JP | 2006-076458 | A | 3/2006 |
| JP | 4027521 | B2 | 12/2007 |
| JP | 4410643 | B2 | 2/2010 |
| JP | 2010-228688 | A | 10/2010 |
| JP | 2011-126404 | A | 6/2011 |
| JP | 2011-173529 | A | 9/2011 |
| JP | 2014-118110 | A | 6/2014 |
| JP | 2014-148277 | A | 8/2014 |

OTHER PUBLICATIONS

PCT/ISA/237, "Written Opinion of the International Searching Authority for International Application No. PCT/JP2013/076153," Oct. 22, 2013.
Japan Patent Office, "Office Action for Japanese Patent Application No. 2013-029305," Mar. 15, 2016.

* cited by examiner

TRAFFIC CONTROL DEVICE, TRAFFIC CONTROL METHOD, AND PROGRAM

RELATED APPLICATIONS

The present application is National Phase of International Application No. PCT/JP2013/076153 filed Sep. 26, 2013, and claims priority from Japanese Application No. 2013-029305, filed Feb. 18, 2013, the disclosure of which is hereby incorporated by reference herein in its entirety.

TECHNICAL FIELD

The present invention relates to a traffic control device, a traffic control method, and a program which manage operation of a plurality of vehicles operating in a predetermined traveling pattern.

The present application claims priority based on Japanese Patent Application No. 2013-029305, filed Feb. 18, 2013, the content of which is incorporated herein by reference.

BACKGROUND ART

In recent years, it has become desirable to reduce power consumption for a vehicle operating with electric power supplied from an overhead wire. PTL 1 discloses a technique which, when a time point at which a vehicle arrives at a check point on a traveling track of the vehicle is earlier than an arrival time point at the check point predicted from an operation condition, controls the vehicle according to a traveling pattern suppressing power consumption of the vehicle. PTL 1 also discloses a technique which, when a powering vehicle exists in a certain area, decelerates other vehicles in the same area.

PTL 2 discloses a technique which, when creating an operation schedule, displays a regeneration rate, which is the ratio between the total regenerative power amount and the total acceleration power amount, according to the conditions for changing the operation schedule.

CITATION LIST

Patent Literature

[PTL 1] Japanese Patent No. 4027421
[PTL 2] Japanese Patent No. 4410643

SUMMARY OF INVENTION

Technical Problem

According to the method disclosed in PTL 1, the traveling pattern of the vehicle actually operating is changed in an ad hoc manner, thereby achieving energy saving. However, if the original operation schedule is not appropriately set, it is not possible to achieve sufficient energy saving. According to the method disclosed in PTL 2, while regenerative power is visualized, an optimized operation schedule is not identified in terms of energy saving. In the method disclosed in PTL 2, a manager needs to plan an operation schedule.

According to the methods disclosed in PTLs 1 and 2, any traveling pattern of a plurality of traveling patterns prepared in advance is selected, thereby achieving energy saving. In order to achieve sufficient energy saving, it is necessary to prepare a traveling pattern conforming to an inter-station distance or a route state (gradient or the like). If a traveling pattern conforming to an inter-station distance or a route state (gradient or the like) is prepared, the number of traveling patterns is increased. If the number of traveling patterns is increased, the number of patterns of a simulation is increased. If the number of patterns of a simulation is increased, a lot of time is required until the convergence to an optimum operation schedule.

An object of the invention is to provide a traffic control device, a traffic control method, and a program which solve the above-described problems.

Solution to Problem

According to a first aspect of the invention, there is provided a traffic control device that manages operation of a plurality of vehicles operating in a predetermined traveling pattern. The traffic control device according to the first aspect includes an adjustment value setting unit that sets an adjustment value including at least one of a station stop time and a departure interval for each vehicle. The traffic control device according to the first aspect includes an electric power calculation unit that calculates power consumption and regenerative power of each vehicle when the vehicles travel using the adjustment value set by the adjustment value setting unit and the traveling pattern on a per time point basis. The traffic control device according to the first aspect includes an evaluation value calculation unit that, on a per time time point basis on which the electric power calculation unit calculates power consumption and regenerative power, executes the following steps: 1. a step of calculating total vehicle power at each time point by subtracting the total of regenerative power from braking vehicles from the total of power consumption from powering vehicles; 2. a step of extracting at least one value of a positive value and a negative value from the total vehicle power at each time point; and 3. a step of calculating an evaluation value using the absolute value of the total of the extracted values. The traffic control device according to the first aspect includes an optimum value identification unit that identifies the adjustment value producing a smaller evaluation value calculated by the evaluation value calculation unit.

According to a second aspect of the invention, in the traffic control device according to the first aspect, on a per time point basis, the evaluation value calculation unit calculates the total vehicle power at the time point in the following order. The evaluation value calculation unit subtracts, from the total of a maximum value of power consumption from each powering vehicle for a predetermined variation time, the total of regenerative power from each braking vehicle for the variation time. The variation time is a time that centers the time point.

According to a third aspect of the invention, in the traffic control device according to the first or the second aspect, the evaluation value calculation unit calculates the evaluation value in the following order. The evaluation value calculation unit adds a value for each vehicle to the absolute value of the total of the extracted values. The value is a value based on the difference between the adjustment value of the vehicle and a reference value of the adjustment value determined in advance.

According to a fourth aspect of the invention, in the traffic control device according to any one of the first to the third aspects, the adjustment value setting unit sets at least a station stop time as an adjustment value. The evaluation value calculation unit according to the fourth aspect calculates the evaluation value by adding a penalty value to the absolute value of the total of the extracted values. The penalty value is a value imposed when the station stop time is shorter than a minimum station stop time determined in advance for each vehicle.

According to a fifth aspect of the invention, in the traffic control device according to any one of the first to the fourth aspects, the traffic control device further includes a traveling pattern setting unit that sets one of a plurality of traveling patterns for at least one of the vehicles and routes between stations. The electric power calculation unit calculates power consumption and regenerative power of each vehicle when the vehicle travel on a per time point basis using an adjustment value and a traveling pattern. The adjustment value is an adjustment value set by the adjustment value setting unit. The traveling pattern is a traveling pattern set by the traveling pattern setting unit. The optimum value identification unit according to the fifth aspect identifies the adjustment value and the traveling pattern that produce a smaller evaluation value calculated by the evaluation value calculation unit.

According to a sixth aspect of the invention, the plurality of traveling patterns according to the fifth aspect, are different in a maximum speed with the same starting acceleration and stopping acceleration.

According to the seventh aspect of the invention, there is provided a traffic control method for a plurality of vehicles operating in a predetermined traveling pattern. The traffic control method according to the seventh aspect includes a step of setting an adjustment value including at least one of a station stop time and a departure interval for each vehicle. The traffic control method according to the seventh aspect includes a step of calculating power consumption and regenerative power of each vehicle when the vehicles travel using the set adjustment value and the traveling pattern on a per time point basis. The traffic control method according to the seventh aspect includes a step of calculating total vehicle power at each time point by subtracting the total of regenerative power from braking vehicles from the total of power consumption from powering vehicles on a per time point basis. The traffic control method according to the seventh aspect includes a step of extracting at least one value of a positive value and a negative value from the total vehicle power at each time point. The traffic control method according to the seventh aspect includes a step of calculating an evaluation value using the absolute value of the total of the extracted values. The traffic control method according to the seventh aspect includes a step of identifying the adjustment value producing a smaller evaluation value.

According to the eighth aspect of the invention, there is a program that causes a computer of a traffic control device, which manages operation of a plurality of vehicles operating in a predetermined traveling pattern, to function as an adjustment value setting unit, an evaluation value calculation unit, and an optimum value identification unit. The adjustment value setting unit sets an adjustment value including at least one of a station stop time and a departure interval for each vehicle. The electric power calculation unit calculates power consumption and regenerative power of each vehicle when the vehicles travel using the adjustment value set by the adjustment value setting unit and the traveling pattern on a per time point basis. The evaluation value calculation unit, on a per time point basis on which the electric power calculation unit calculates power consumption and regenerative power, executes the following steps: 1. a step of calculating total vehicle power at each time point by subtracting the total of regenerative power from braking vehicles from the total of power consumption from powering vehicles; 2. a step of extracting at least one value of a positive value and a negative value from the total vehicle power at each time point; and 3. a step of calculating an evaluation value using the absolute value of the total of the extracted values. The optimum value identification unit identifies the adjustment value producing a smaller evaluation value calculated by the evaluation value calculation unit.

Advantageous Effects of Invention

According to the above-described aspects, the traffic control device obtains the optimum value of at least one of the station stop time and the departure interval. With this, the traffic control device obtains an optimum operation schedule when a vehicle travels in a predetermined traveling pattern. The traffic control device can obtain the optimum operation schedule in a short time by reducing the number of traveling patterns.

DESCRIPTION OF EMBODIMENTS

First Embodiment

Figure 1:
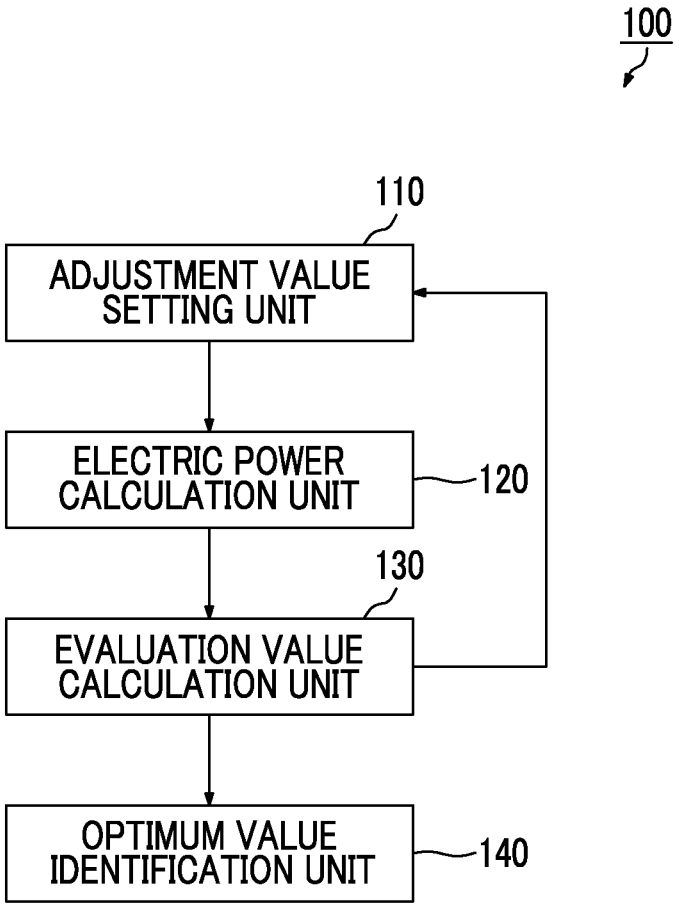
FIG. 1 is a schematic block diagram showing the configuration of a traffic control device according to a first embodiment of the invention.

Hereinafter, an embodiment will be described in detail referring to the drawings.

FIG. 1 is a schematic block diagram showing the configuration of a traffic control device 100 according to a first embodiment of the invention.

The traffic control device 100 generates an operation schedule of a plurality of vehicles. The vehicles are operated with power from a wire. The traffic control device 100 manages operation of the vehicles. The traffic control device 100 includes an adjustment value setting unit 110, an electric power calculation unit 120, an evaluation value calculation unit 130, and an optimum value identification unit 140.

The adjustment value setting unit 110 sets a station stop time (adjustment value) of each station for each vehicle, and a departure interval (adjustment value) for each vehicle. The station stop time is a time during which the vehicle is stopped. The stations are provided in a section where the vehicle travels. The departure interval is the time which spans from the departure of a preceding vehicle at a start point of the section where the vehicle travels to the departure of the vehicle.

The electric power calculation unit 120 calculates power consumption at each time point by a simulation when each vehicle travels in one traveling pattern determined in advance. The electric power calculation unit 120 calculates power consumption using the station stop time and the departure interval set by the adjustment value setting unit 110. In this embodiment, the electric power calculation unit 120 calculates power consumption as power of a positive value and calculates regenerative power as power of a negative value. When the value calculated by the electric power calculation unit 120 as power consumption at a certain time point is a negative value, power corresponding to the absolute value of the calculated value is recovered to an overhead wire. The electric power calculation unit 120 may simulate the operation of the vehicles at a peak times. The electric power calculation unit 120 may simulate the operation of the vehicles for the time until all vehicles return to the original positions.

Figure 2:
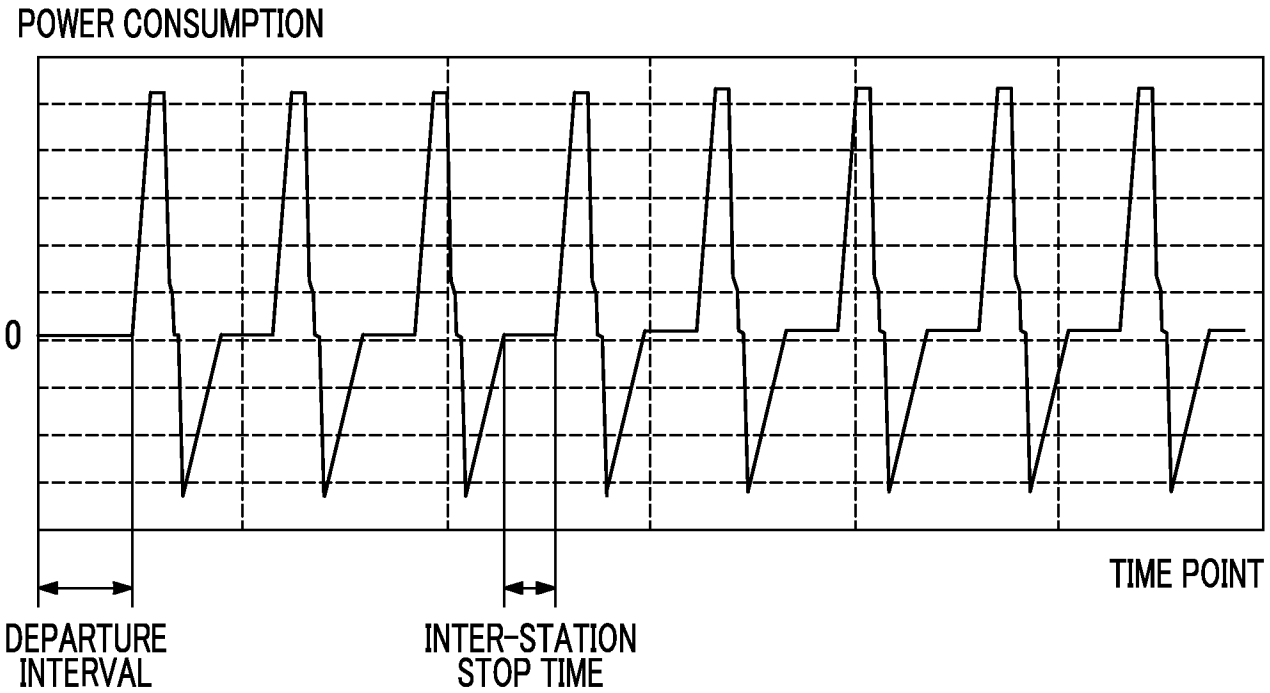
FIG. 2 is a diagram showing an example of a simulation result by an electric power calculation unit.

FIG. 2 is a diagram showing an example of a simulation result by the electric power calculation unit 120.

If the traveling for one vehicle is simulated, as shown in FIG. 2, the electric power calculation unit 120 outputs power consumption at each time point. As shown in FIG. 2, a calculation result of the electric power calculation unit 120 becomes a value according to the departure interval or the inter-station stop time set by the adjustment value setting unit 110. The electric power calculation unit 120 outputs the relationship between time and power shown in FIG. 2 for each vehicle.

The evaluation value calculation unit 130 calculates an evaluation value when the station stop time and the departure interval set by the adjustment value setting unit 110 are used. The evaluation value calculation unit 130 calculates an evaluation value based on power consumption at each time point calculated by the electric power calculation unit 120. When the evaluation value is smaller, this represents that energy saving is high. Specifically, the evaluation value calculation unit 130 calculates an evaluation value by the following procedure. The evaluation value calculation unit 130 totals power calculated by the electric power calculation unit 120 on a per time point basis. Next, the evaluation value calculation unit 130 calculates an evaluation value by adding only the positive values of the total of power at each time point.

The optimum value identification unit 140 identifies a station stop time and a departure interval associated with the smallest value among the evaluation values calculated by the evaluation value calculation unit 130 as optimum values of a station stop time and a departure interval. The optimum value identification unit 140 identifies the optimum values, whereby the traveling pattern, the station stop time, and the departure interval are determined. With this, the traffic control device 100 can identify an operation schedule for energy saving.

A calculation method of an evaluation value by the evaluation value calculation unit 130 will be described in detail.

The evaluation value calculation unit 130 calculates an evaluation value J using Expression (1) described below.

[Equation 1]

$$J = \int_0^T \left( \mathrm{MAX}\left( \sum_{i=1}^{n} (P_i(t, t_{hi}, t_{di})), 0 \right) \right) dt \tag{1}$$

T represents time to be evaluated. A function MAX is a function which selects the greatest value among a plurality of numerical values in parentheses. n represents the total number of vehicles. $P_i$ (t, $t_{hi}$, $t_{di}$) represents power consumption of an i-th vehicle at a time point t when the departure interval of the i-th vehicle is $t_{hi}$ and the station stop time is $t_{di}$. The station stop time $t_{di}$ is a series which includes a stop time set for each station. For example, when the number of stations is m, the station stop time $t_{di}$ becomes a series which is made of m numerical values.

The evaluation value calculation unit 130 first calculates power consumption Pi (t, $t_{hi}$, $t_{di}$) of each vehicle for each time point t from a time point 0 to a time point T. Next, the evaluation value calculation unit 130 calculates the total vehicle power $\Sigma(P_i(t, t_{hi}, t_{di}))$ which is the total of power consumption of each vehicle at the time point t. As described above, when regenerative power is generated by braking of the vehicle, the electric power calculation unit 120 outputs power consumption in the form of a negative value. For this reason, the calculation of the total by the evaluation value calculation unit 130 is equivalent to calculation of subtracting the total of regenerative power from braking vehicles from the total of power consumption from powering vehicles. Next, the evaluation value calculation unit 130 extracts only the positive values in the total vehicle power calculated at each time point by the MAX function. With this, when regenerative power which is not used by other vehicles is greater, the evaluation value becomes higher. Next, the evaluation value calculation unit 130 calculates the evaluation value J by calculating the total of the extracted values. The evaluation value J is equal to the absolute value of the extracted positive value of the total vehicle power.

Next, the operation of the traffic control device 100 of the first embodiment will be described. In this embodiment, an example where a station stop time and a departure interval are optimized using a genetic algorithm will be described. The optimization of the station stop time and the departure interval is not limited to the genetic algorithm, and for example, may use other solution search methods, such as a branch and bound method or a Nelder-Mead method. The Nelder-Mead method is a wide-range nonlinear optimization method which searches for a solution by the following procedure. First, a simplex having more vertexes than independent variables is produced. Next, the simplex is corrected based on the remaining vertexes of a point having the worst evaluation value among the vertexes of the simplex.

Figure 3:
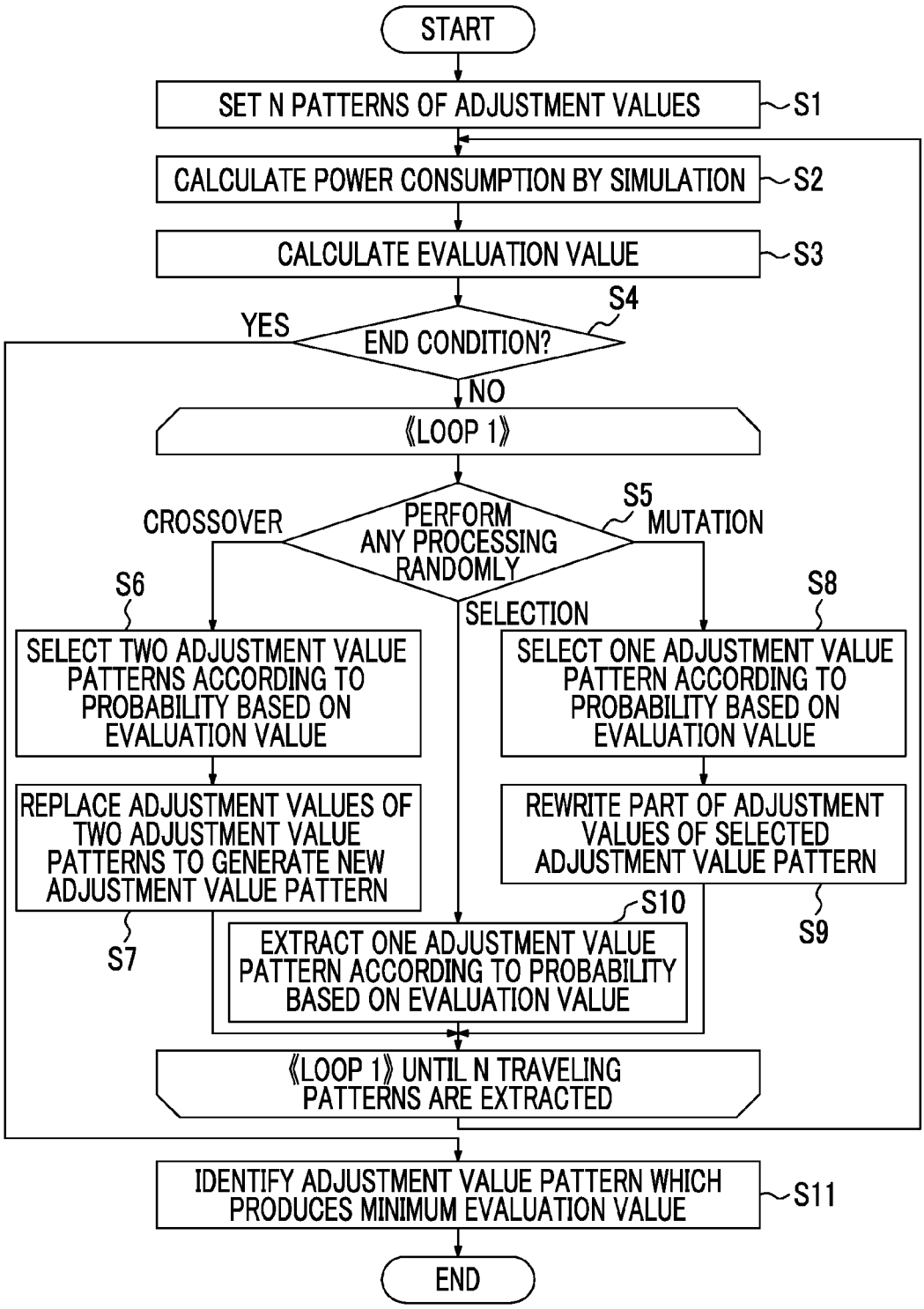
FIG. 3 is a flowchart showing the operation of the traffic control device according to the first embodiment of the invention.

FIG. 3 is a flowchart showing the operation of the traffic control device 100 of the first embodiment.

First, the adjustment value setting unit 110 sets N patterns of a combination of the station stop time of each station for each vehicle and the departure interval for each vehicle (Step S1). The adjustment value setting unit 110 may set an initial station stop time and departure interval based on a random number. The adjustment value setting unit 110 may set the initial station stop time and departure interval by the manual input of a user or the like.

Next, the electric power calculation unit 120 performs a traveling simulation of all vehicles for each pattern of adjustment values set by the adjustment value setting unit 110. Next, the electric power calculation unit calculates power consumption at each time point based on the traveling simulation (Step S2). Next, the evaluation value calculation unit 130 calculates the evaluation value of power consumption for each pattern of adjustment values using Expression (1) described above (Step S3).

Next, the optimum value identification unit 140 determines whether or not the end condition for the calculation of the evaluation value is satisfied (Step S4). The end condition for the calculation of the evaluation value is, for example, that the number of executions of the simulation by the electric power calculation unit 120 reaches a predetermined number, the difference in the minimum value of the evaluation value calculated by the evaluation value calculation unit 130 is less than a predetermined value, or the like.

When the optimum value identification unit 140 determines that the end condition for the calculation of the evaluation value is not satisfied (Step S4: NO), the traffic control device 100 performs a genetic operation based on a genetic algorithm for the patterns of the adjustment values which produce the evaluation value. That is, the traffic control device 100 performs the operation of selection, crossover, or mutation such that a pattern producing a smaller evaluation value from among the patterns of adjustment values set by the adjustment value setting unit 110 remains. The traffic control device 100 repeatedly executes the operations of Steps S5 to S10 described below.

First, the adjustment value setting unit 110 determines whether to perform any operation of selection, crossover, and mutation randomly (Step S5). Normally, in the genetic algorithm, the probability of determining whether or to perform any processing is set in an order of the probability of performing the crossover operation≥the probability of performing the selection operation≥the probability of performing the mutation operation.

When it is determined to perform the crossover operation (Step S5: CROSSOVER), the adjustment value setting unit 110 selects two patterns of adjustment values from among a plurality of patterns of adjustment values which produce the evaluation value calculated by the evaluation value calculation unit 130 (Step S6). The adjustment value setting unit 110 selects the two patterns of adjustment values according to a probability based on the weight according to the evaluation value. The pattern of adjustment values with a smaller evaluation value has a large weight and is thus easily selected by the adjustment value setting unit 110.

Next, the adjustment value setting unit 110 replaces the selected two patterns of adjustment values to newly generate a pattern of adjustment values (Step S7). As a replacement method of a pattern of adjustment values, any method of a one-point crossover method, a two-point crossover method, and a multi-point crossover method may be used. The adjustment value setting unit 110 may replace the station stop time or the departure interval for each vehicle. The adjustment value setting unit 110 may replace the station stop time for each station.

When it is determined to perform the mutation operation in Step S5 (Step S5: MUTATION), the adjustment value setting unit 110 selects one pattern of adjustment values from a plurality of patterns of adjustment values which produce the evaluation value calculated by the evaluation value calculation unit 130 (Step S8). The adjustment value setting unit 110 selects one pattern of adjustment values according to a probability based on a weight according to the evaluation value. Next, the adjustment value setting unit 110 newly generates a pattern of adjustment values by rewriting a part of the adjustment values of the selected pattern of adjustment values randomly (Step S9).

When it is determined to perform the selection operation in Step S5 (Step S5: SELECTION), the adjustment value setting unit 110 extracts one pattern of adjustment values from among a plurality of patterns of adjustment values, which produce the evaluation value calculated by the evaluation value calculation unit 130, as an object of the simulation (Step S10). The adjustment value setting unit 110 extracts one pattern of adjustment values according to a probability based on a weight according to the evaluation value.

Through the processing of Steps S5 to S10 described above, if the adjustment value setting unit 110 extracts N patterns of adjustment values, the traffic control device 100 returns to Step S2. If returned to Step S2, the traffic control device 100 performs a traveling simulation of all vehicles for each pattern of adjustment values.

With the repetitive execution of the above-described processing, when the optimum value identification unit 140 determines that the end condition of Step S4 is satisfied (Step S4: YES), the optimum value identification unit 140 identifies a pattern for actual operation (Step S11). The optimum value identification unit 140 identifies a pattern of adjustment values, which produce the minimum evaluation value calculated by the evaluation value calculation unit 130, as a pattern for actual operation.

In this way, according to the first embodiment, the traffic control device 100 identifies the station stop time of each station for each vehicle and the departure interval for each vehicle such that the evaluation value calculated by Expression (1) becomes smaller. With this, the traffic control device 100 can identify an operation schedule capable of effectively using regenerative power. The traffic control device 100 can identify an optimum solution in a short time by fixing a traveling pattern and deriving an optimum pattern of the station stop time and the departure interval.

According to the first embodiment, it is possible to identify an optimum solution in a short time by fixing a traveling pattern. In the related art, since a lot of time is required to identify an optimum solution, an operation schedule needs to be calculated offline, and the vehicle needs to travel according to the operation schedule. The traffic control device 100 of the first embodiment can recognize the states of the vehicles online and can change the traveling pattern.

In the first embodiment, a case where the adjustment value setting unit 110 sets the station stop time of each station for each vehicle and the departure interval for each vehicle as the adjustment values has been described. The invention is not limited thereto, and in other embodiments, any of the station stop time and the departure interval may be fixed, and the adjustment value setting unit 110 may use only one of the station stop time and the departure interval as the adjustment values.

In the first embodiment, a case where the adjustment value setting unit 110 sets the station stop time for each vehicle and each station has been described. The invention is not limited thereto, and in other embodiments, the adjustment value setting unit 110 may set the station stop time common to all stations for each vehicle. In other embodiments, the adjustment value setting unit 110 may set the station stop time common to all vehicles for each station.

In the first embodiment, a case where the evaluation value calculation unit 130 calculates the evaluation value based on power consumption by extracting only the positive values of the calculated total vehicle power at each time point using the MAX function in Expression (1) has been described. The invention is not limited thereto, and in other embodiments, for example, the evaluation value calculation unit 130 may calculate an evaluation value based on regenerative power by extracting only the negative value of the total vehicle power using a MIN function and taking the absolute value of the negative value. In other embodiments, the evaluation value calculation unit 130 may calculate the evaluation value based on power consumption and the evaluation value based on regenerative power, and the optimum value identification unit 140 may identify the adjustment values based on both evaluation values.

In the first embodiment, although a case where the traffic control device 100 achieves the optimization of the evaluation value using the genetic algorithm has been described, the invention is not limited thereto. For example, in other embodiments, the traffic control device 100 may perform a predetermined number of simulations and may identify adjustment values, which produce the smallest evaluation value obtained from the result of each simulation, as adjustment values for actual operation.

Second Embodiment

Next, a traffic control device 100 of a second embodiment will be described.

In the traffic control device 100 of the second embodiment, the calculation method of the evaluation value by the evaluation value calculation unit 130 is different from that in the first embodiment.

If a vehicle actually travels, variation occurs between an actual traveling distance at each time point and a traveling distance determined by an operation schedule. The variation occurs since the departure time point of the station is shifted back and forth. The traffic control device 100 of the second embodiment identifies a combination of optimum adjustment values in consideration of the variation.

Figure 4A:
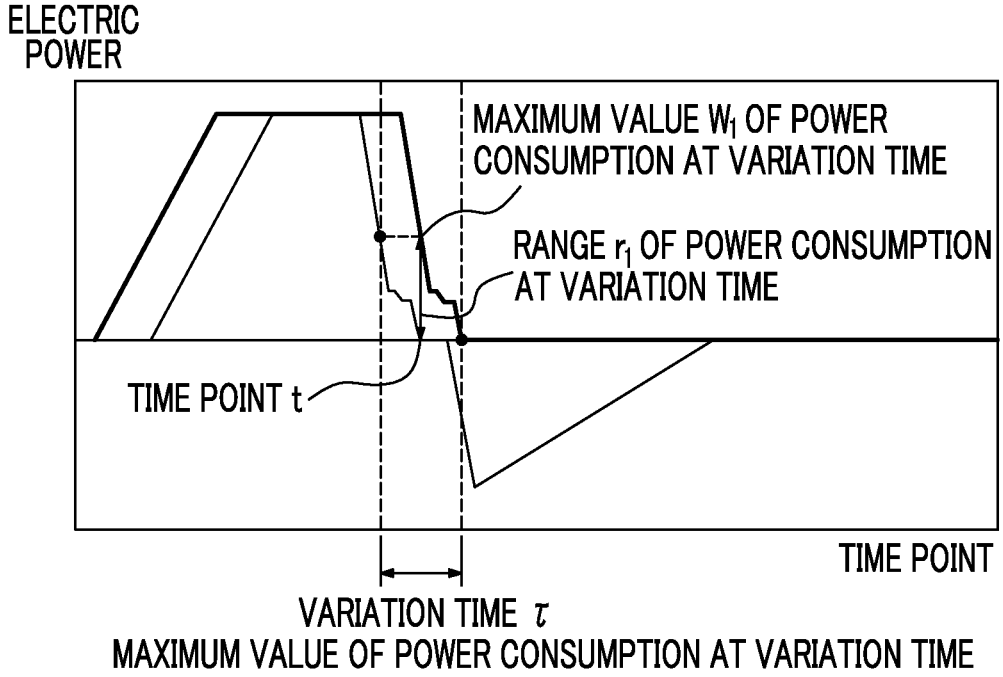
FIG. 4A is a diagram showing a calculation method of total vehicle power by an evaluation value calculation unit according to a second embodiment of the invention.
Figure 4B:
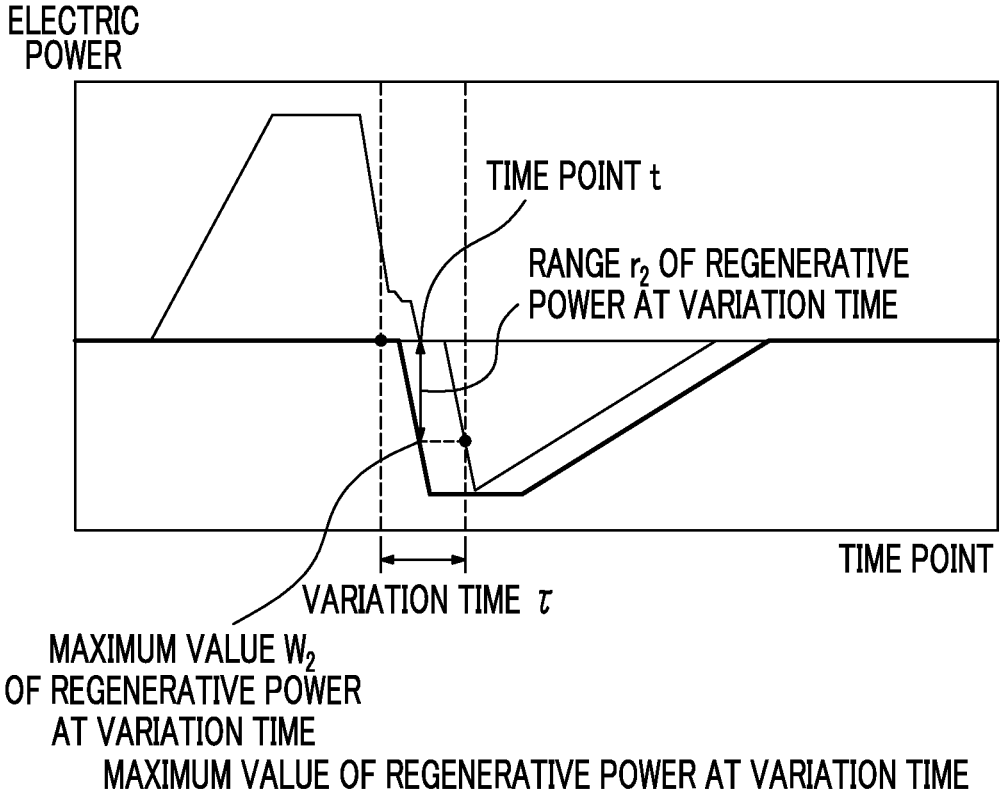
FIG. 4B is a diagram showing a calculation method of total vehicle power by the evaluation value calculation unit according to the second embodiment of the invention.

FIG. 4A is a diagram showing a calculation method of a maximum value of power consumption by the evaluation value calculation unit 130 of the second embodiment. FIG. 4B is a diagram showing a calculation method of a maximum value of regenerative power by the evaluation value calculation unit 130 of the second embodiment.

The evaluation value calculation unit 130 of the second embodiment calculates the total vehicle power at each time point in consideration of a variation time $\tau$. The variation time $\tau$ is a time which is assumed as variation of the departure time at each station. Specifically, first, as shown in FIG. 4A, the evaluation value calculation unit 130 calculates a maximum value $W_1$ from a range $r_1$ of power consumption of each powering vehicle at a predetermined variation time $\tau$ centering on the time point (in FIG. 4A, a time point t) on a per time point basis. The maximum value $W_1$ of power consumption of the vehicle at the variation time $\tau$ becomes a value equal to or greater than 0. Similarly, as shown in FIG. 4B, the evaluation value calculation unit 130 calculates a maximum value $W_2$ from a range $r_2$ of regenerative power of each braking vehicle at a predetermined variation time $\tau$ centering on the time point (in FIG. 4B, a time point t) on a per time point basis. Any maximum value W2 of regenerative power of the vehicle at the variation time $\tau$ becomes a value equal to or less than 0 when converted to power consumption. The evaluation value calculation unit 130 calculates the total vehicle power at each time point by subtracting the maximum value $W_2$ of regenerative power of each vehicle at the variation time $\tau$ from the maximum value $W_1$ of power consumption of each vehicle at the variation time $\tau$.

That is, the calculation of the evaluation value by the evaluation value calculation unit 130 of the second embodiment can be obtained by Expression (2) described below.

[Equation 2]

$$J = \int_0^T \left( \mathrm{MAX}\left( \sum_{i=1}^{n} \left( \max_{\tau_i}{}^{+} P_i(t, \tau_i, t_{hi}, t_{di}) + \max_{\tau_i}{}^{-} P_i(t, \tau_i, t_{hi}, t_{di}) \right), 0 \right) \right) dt \quad (2)$$

A function $\max^+$ is a function which represents the maximum value of power consumption at the variation time $\tau T_i$ centering on the time point t. A function $\max^-$ is a function which represents a value obtained by converting the maximum value of regenerative power at the variation time $\tau_i$ centering on the time point t to power consumption. $P_i(t, \tau_i, t_{hi}, t_{di})$ represents power consumption of an i-th vehicle at the time point t when the departure interval of the i-th vehicle is $t_{hi}$, the station stop time is $t_{di}$, and the variation time is $\tau_i$.

In this way, according to the second embodiment, the traffic control device 100 can obtain a more robust operation schedule by planning an operation schedule using the adjustment values according to the second embodiment. This is because the evaluation value calculation unit 130 calculates the evaluation value in consideration of variation of the departure time from the operation schedule.

In this embodiment, although a case where the traffic control device 100 uses the same value for each vehicle as the variation time $\tau_i$ of the departure time at each time point has been described, the invention is not limited thereto. For example, if it is assumed that the shift from the operation schedule is increased in small increments for each station, the variation time of the departure time can be set for each station.

Third Embodiment

Next, a third embodiment will be described.

In a traffic control device 100 of the third embodiment, the calculation method of the evaluation value by the evaluation value calculation unit 130 is different from that in the first and second embodiments.

In general, in regards to the station stop time and the departure interval of the vehicle, reference values (for example, headway or round-trip time) are determined in advance. For example, if the departure interval of the vehicle is set to be significantly great, it is assumed that the headway or round-trip time of each station is extended, and the use of the vehicle is inconvenient. The traffic control device 100 of the third embodiment identifies a combination of adjustment values which have a small amount of shift from reference values and achieve energy saving.

The evaluation value calculation unit 130 of the third embodiment calculates an evaluation value by adding penalty values based on the differences between the adjustment values of each vehicle and the reference values to the evaluation value calculated by the calculation method of the second embodiment. In the third embodiment, the evaluation value calculation unit 130 adds a penalty value for the departure interval (that is, the headway at the first station) and a penalty value for the round-trip time as the penalty values.

The evaluation value calculation unit 130 calculates the penalty value of the departure interval by multiplying the square sum of the difference between the departure interval of each vehicle and the reference value of the departure interval by a predetermined weight. With this, when the difference between the departure interval and the reference value is deviated, the penalty value becomes greater.

The evaluation value calculation unit 130 calculates the penalty value of the round-trip time by multiplying the square sum of the difference between the sum of the station stop time at each station of the inter-station traveling time and the reference value of the round-trip time by a predetermined weight. With this, when the round-trip time of each vehicle is deviated from the reference value of the round-trip time, the penalty value becomes greater.

That is, the calculation of the evaluation value by the evaluation value calculation unit 130 of the third embodiment can be obtained by Expression (3) described below.

[Equation 3]

$$J = \int_0^T \left( \mathrm{MAX}\left( \sum_{i=1}^{n} \left( \max_{\tau_i}{}^{+} P_i(t, \tau_i, t_{hi}, t_{di}) + \max_{\tau_i}{}^{-} P_i(t, \tau_i, t_{hi}, t_{di}) \right), 0 \right) \right) dt + w_1 \sum_{i=1}^{n} (t_{h_i} - \bar{t}_h)^2 + w_2 \sum_{i=1}^{n} \left( \sum_{j=1}^{m} (t_{r_{ij}} + t_{d_{ij}}) - RTT \right)^2 \quad (3)$$

$w_1$ represents the weight of the penalty value of the departure interval. $t_h$ (with overbar) represents the reference value of the departure interval of the i-th vehicle. $t_{rij}$ represents a time during which the i-th vehicle travels between a j-th station and a (j+1)th station. $t_{dij}$ represents the station stop time of the j-th station for the i-th vehicle. RTT represents the reference value of the round-trip time.

In this way, according to the third embodiment, the traffic control device 100 can generate an operation schedule, which achieves energy saving while minimizing the errors from the reference values, by planning an operation schedule using the adjustment values according to the third embodiment. This is because the evaluation value calculation unit 130 calculates the evaluation value in consideration of the shift from the reference values.

In the third embodiment, although a case where the evaluation value calculation unit 130 calculates the evaluation value by adding the penalty values to the evaluation value calculated by the calculation method of the second embodiment has been described, the invention is not limited thereto. In other embodiments, for example, the evaluation value calculation unit may calculate the evaluation value by adding the penalty values to the evaluation value calculated by the calculation method of the first embodiment.

Fourth Embodiment

Next, a fourth embodiment will be described.

In a traffic control device 100 of the fourth embodiment, the calculation method of the evaluation value by the evaluation value calculation unit 130 is different from that in the first to third embodiments.

Practically, at each station of a traffic system, there is a minimum time during which the vehicle should be stopped. If the minimum station stop time is not kept, it is assumed that stepping on the vehicle at the station is difficult, and the use of the vehicle is inconvenient. The traffic control device 100 of the fourth embodiment secures the minimum station stop time and identifies a combination of adjustment values for energy saving.

The evaluation value calculation unit 130 of the fourth embodiment calculates an evaluation value by adding a penalty value based on the station stop time to the evaluation value calculated in the third embodiment.

For example, the evaluation value calculation unit 130 can calculate the penalty value of the station stop time by taking a square sum for the reciprocal of a value obtained for each vehicle by subtracting a set station stop time from the minimum station stop time at each station. With this, when the minimum station stop time is not secured, the penalty value becomes infinite.

In this way, according to the fourth embodiment, it is possible to generate an operation schedule, which achieves energy saving while securing the minimum station stop time, by planning an operation schedule using the adjustment values according to the fourth embodiment. This is because the evaluation value calculation unit 130 calculates an evaluation value in consideration of the minimum station stop time.

In the fourth embodiment, although a case where the evaluation value calculation unit 130 calculates the evaluation value by adding the penalty value to the evaluation value calculated by the calculation method of the third embodiment has been described, the invention is not limited thereto. In other embodiments, for example, the evaluation value calculation unit 130 may calculate an evaluation value by adding the penalty value to the evaluation value calculated by the calculation method of the first or second embodiment.

In the fourth embodiment, although a case where the penalty value of the station stop time is the square sum of the reciprocal of the value obtained by subtracting the set station stop time from the minimum station stop time at each station has been described, the invention is not limited thereto. For example, in other embodiments, when the value obtained by subtracting the minimum station stop time from the station stop time at each station is a negative value, the penalty value of the station stop time may be the absolute value of the value. In other embodiments, when the value obtained by subtracting the minimum station stop time from the station stop time at each station is a positive value, the penalty value of the station stop time may be 0.

Fifth Embodiment

Next, a fifth embodiment will be described.

In the first to fourth embodiments, a case where the traffic control device 100 performs optimization based on one traveling pattern set in advance has been described. In the fifth embodiment, the traffic control device 100 performs optimization using a plurality of traveling patterns. With this, the traffic control device 100 can generate an operation schedule which can realize energy saving.

Figure 5:
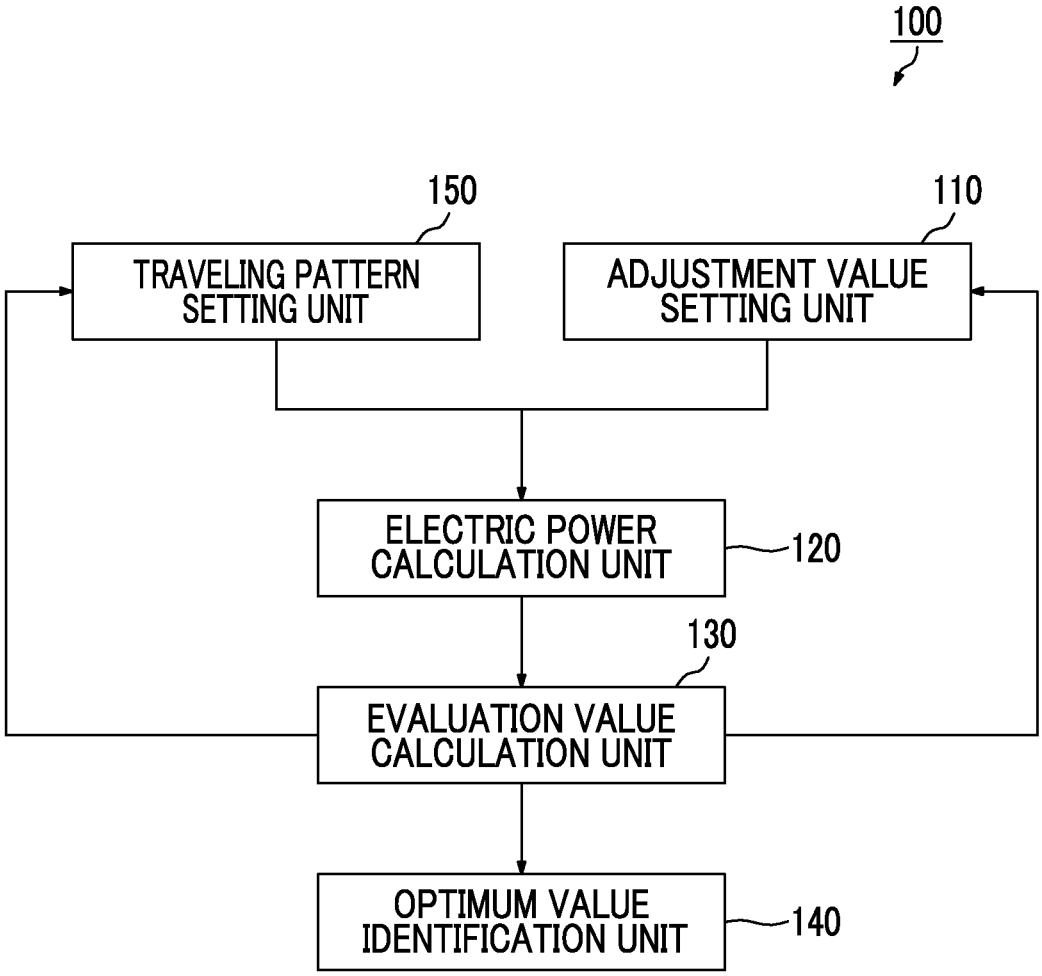
FIG. 5 is a schematic block diagram showing the configuration of a traffic control device according to a fifth embodiment of the invention.

FIG. 5 is a schematic block diagram showing the configuration of a traffic control device 100 of the fifth embodiment.

The traffic control device 100 of the fifth embodiment further includes a traveling pattern setting unit 150 in addition to the configuration of the traffic control device 100 of the first to fourth embodiments. The traveling pattern setting unit 150 sets a traveling pattern selected from among a plurality of traveling patterns for each vehicle and each route between the stations.

The traveling pattern setting unit 150 can minimize the number of setting parameters by taking only the maximum speed as a setting parameter and setting a starting acceleration and a stopping acceleration to fixed values. In this case, the station arrival time t can be calculated using Expression (4) described below.

[Equation 4]

$$t = \frac{L}{V\max} + \frac{V\max(a1 + a2)}{a1 \cdot a2} - 1 \quad (4)$$

Vmax represents a maximum speed. L represents an inter-station distance. a1 represents a starting acceleration. a2 represents a stopping acceleration.

The electric power calculation unit 120 and the evaluation value calculation unit 130 of the fifth embodiment perform the simulation and the calculation of the evaluation value using the traveling pattern. The traveling pattern setting unit 150 changes the traveling pattern based on the evaluation value.

In this way, according to the fifth embodiment, in the traffic control device 100, the traveling pattern setting unit 150 changes the traveling pattern. With this, the traffic control device 100 can generate an operation schedule which achieves more energy saving.

In the fifth embodiment, although a case where the traveling pattern setting unit 150 sets the traveling pattern for each vehicle and each route between the stations has been described, the invention is not limited thereto. In other embodiments, the traveling pattern setting unit 150 may fix the traveling pattern of each route and may set the traveling pattern for each vehicle. In other embodiments, the traveling pattern setting unit 150 may fix the traveling pattern of each vehicle and may set the traveling pattern for each route.

A few embodiments have been described in detail referring to the drawings. However, a specific configuration is not limited to those described above. Various design changes or the like may be made to a specific configuration without departing from the spirit and scope of the invention.

The above-described traffic control device 100 has an internal computer system. The operation of each processing unit described above is recorded in a non-transitory computer-readable recording medium in the form of a program. The computer reads and executes the program, whereby the processing is performed. The non-transitory computer-readable recording medium refers to a magnetic disk, a magneto-optical disk, a CD-ROM, a DVD-ROM, a semiconductor memory, or the like. The computer program may be distributed to the computer by a communication line, and the computer which receives the distribution may execute the program.

The program may implement some of the functions described above. The program may also be a so-called differential file (differential program) that implements the functions described above in combination with a program already recorded in the computer system.

INDUSTRIAL APPLICABILITY

The traffic control device obtains the optimum value of at least one of the station stop time and the departure interval, thereby obtaining an optimum operation schedule when a vehicle travels in a predetermined traveling pattern. In this way, the number of traveling patterns is decreased, whereby the traffic control device can obtain an optimum operation schedule in a short time.

REFERENCE SIGNS LIST

100: traffic control device, 110: adjustment value setting unit, 120: electric power calculation unit, 130: evaluation value calculation unit, 140: optimum value identification unit, 150: traveling pattern setting unit

The invention claimed is:

1. A traffic control device that manages operation of a plurality of vehicles operating in a predetermined traveling pattern, the traffic control device comprising:

an adjustment value setting unit that sets an adjustment value including at least one of a station stop time and a departure interval for each vehicle;

an electric power calculation unit that calculates power consumption and regenerative power of each vehicle when the vehicles travel using the adjustment value set by the adjustment value setting unit and the traveling pattern on a per time point basis;

an evaluation value calculation unit that, on the per time point basis on which the electric power calculation unit calculates the power consumption and the regenerative power, executes a step of calculating a total vehicle power at each time point by subtracting a total of regenerative power from braking vehicles from a total of power consumption from powering vehicles, a step of extracting at least one value of a positive value and a negative value from the total vehicle power at each time point, and a step of calculating an evaluation value using an absolute value of a total of the extracted values; and an optimum value identification unit that identifies the adjustment value producing a smaller evaluation value calculated by the evaluation value calculation unit, wherein, on the per time point basis, the evaluation value calculation unit subtracts, from a total of a maximum value of power consumption from each powering vehicle for a predetermined variation time centering the time point, the total of regenerative power from each braking vehicle for the variation time to calculate the total vehicle power at the time point.

2. The traffic control device according to claim 1, wherein the evaluation value calculation unit calculates the evaluation value by adding, for each vehicle, a value based on a difference between the adjustment value of the vehicle and a reference value of the adjustment value determined in advance to the absolute value of the total of the extracted values.

3. The traffic control device according to claim 2, wherein the adjustment value includes the departure interval, and wherein the evaluation value calculation unit calculates the evaluation value by adding a penalty value to the absolute value of the total of the extracted values, the penalty value calculated by multiplying a square sum of a difference between the departure interval of each vehicle and a reference value of the departure interval by a predetermined weight.

4. The traffic control device according to claim 2, wherein the adjustment value includes the station stop time, and wherein the evaluation value calculation unit calculates the evaluation value by adding a penalty value to the absolute value of the total of the extracted values, the penalty value calculated by multiplying a square sum of a difference between a sum of the station stop time at each station of an inter-station traveling time and a reference value of a round-trip time by a predetermined weight.

5. The traffic control device according to claim 1, wherein the adjustment value setting unit sets said at least station stop time as the adjustment value, and the evaluation value calculation unit calculates the evaluation value by adding, to the absolute value of the total of the extracted values, a penalty value when the station stop time is shorter than a minimum station stop time determined in advance for each vehicle.

6. The traffic control device according to claim 1, further comprising:

a traveling pattern setting unit that sets one of a plurality of traveling patterns for at least one of the vehicles and routes between stations, wherein the electric power calculation unit calculates the power consumption and the regenerative power of each vehicle when the vehicles travel on the per time point basis using the adjustment value set by the adjustment value setting unit and the traveling pattern set by the traveling pattern setting unit, and the optimum value identification unit identifies the adjustment value and the traveling pattern that produce a smaller evaluation value calculated by the evaluation value calculation unit.

7. The traffic control device according to claim 6, wherein the plurality of traveling patterns is different in a maximum speed with same starting acceleration and stopping acceleration.

8. The traffic control device according to claim 1, wherein the variation time is set for each station.

9. A traffic control method for a plurality of vehicles operating in a predetermined traveling pattern, the traffic control method comprising:

a step of setting an adjustment value including at least one of a station stop time and a departure interval for each vehicle;

a step of calculating power consumption and regenerative power of each vehicle when the vehicles travel using the set adjustment value and the traveling pattern on a per time point basis;

a step of calculating a total vehicle power at each time point by subtracting a total of regenerative power from braking vehicles from a total of power consumption from powering vehicles on the per time point basis;

a step of extracting at least one value of a positive value and a negative value from the total vehicle power at each time point;

a step of calculating an evaluation value using an absolute value of a total of the extracted values;

a step of identifying the adjustment value producing a smaller evaluation value; and a step of operating the plurality of vehicles in the adjustment value identified, wherein on the per time point basis, the step of calculating the evaluation value includes subtracting from a total of a maximum value of power consumption from each powering vehicle for a predetermined variation time centering the time point, the total of regenerative power from each braking vehicle for the variation time to calculate the total vehicle power at the time point.

10. A non-transitory computer readable medium which stores a program that causes a computer of a traffic control device, which manages operation of a plurality of vehicles operating in a predetermined traveling pattern, to function as:

an adjustment value setting unit that sets an adjustment value including at least one of a station stop time and a departure interval for each vehicle, an electric power calculation unit that calculates power consumption and regenerative power of each vehicle when the vehicles travel using the adjustment value set by the adjustment value setting unit and the traveling pattern on a per time point basis;

an evaluation value calculation unit that, on the per time point basis on which the electric power calculation unit calculates the power consumption and the regenerative power, executes a step of calculating a total vehicle power at each time point by subtracting a total of regenerative power from braking vehicles from a total of power consumption from powering vehicles, a step of extracting at least one value of a positive value and a negative value from the total vehicle power at each time point, and a step of calculating an evaluation value using an absolute value of a total of the extracted values; and an optimum value identification unit that identifies the adjustment value producing a smaller evaluation value calculated by the evaluation value calculation unit and operates the plurality of vehicles in the adjustment value identified, wherein, on the per time point basis, the evaluation value calculation unit subtracts, from a total of a maximum value of power consumption from each powering vehicle for a predetermined variation time centering the time point, the total of regenerative power from each braking vehicle for the variation time to calculate the total vehicle power at the time point.

* * * * *